US005414886A

United States Patent [19]

Sust et al.

[11] Patent Number: 5,414,886

[45] Date of Patent: May 16, 1995

[54] PNEUMATIC FLOOR SUPPORTS FOR PORTABLE PLATFORMS

[75] Inventors: Eberhard Sust, Mainz; Jan Ghering, Ginsheim-Gustavsburg, both of Germany

[73] Assignee: Man Gutehoffnungshütte AG, Oberhausen, Germany

[21] Appl. No.: 139,530

[22] Filed: Oct. 20, 1993

[51] Int. Cl.[6] ..... E01D 15/12

[52] U.S. Cl. ..... 14/2.5; 14/69.5; 254/93 HP

[58] Field of Search ..... 14/2.4, 2.5, 2.6, 72.5, 14/77.1, 78, 69.5; 193/35 SS; 254/93 HP; 414/430; 52/173.2

[56] References Cited

U.S. PATENT DOCUMENTS

| | | | |
|---|---|---|---|
| 3,145,860 | 8/1964 | Graves | 414/430 |
| 3,208,086 | 9/1965 | Gillois et al. | 14/2.6 |
| 4,596,506 | 6/1986 | Burgardt et al. | 254/93 HP |
| 4,606,090 | 8/1986 | Beard | 14/72.5 |
| 4,675,931 | 6/1987 | Quint | 14/72.5 |

FOREIGN PATENT DOCUMENTS

| | | | |
|---|---|---|---|
| 2846182 | 5/1980 | Germany . | |
| 3138853 | 12/1984 | Germany . | |
| 3719508 | 12/1988 | Germany . | |
| 3106140 | 2/1990 | Germany . | |
| 398326 | 3/1966 | Switzerland | 14/69.5 |

*Primary Examiner*—Ramon S. Britts
*Assistant Examiner*—James A. Lisehorn
*Attorney, Agent, or Firm*—McGlew and Tuttle

[57] ABSTRACT

Movable ground supports, which are folded out either manually or hydraulically, are arranged at the tip of the launching support in devices for laying collapsible bridges. An inflatable container (6) is integrated in the structural part (2) of the launching support (8), and the container acts as a movable support in the filled state. A release mechanism (10) arranged in the vicinity of the container ensures that the medium—compressed air or nitrogen—will escape from the inflated container (6) when the end of the bridge (5) has completely reached the bearing (9) after advancing forward.

5 Claims, 1 Drawing Sheet

PNEUMATIC FLOOR SUPPORTS FOR PORTABLE PLATFORMS

FIELD OF THE INVENTION

The present invention pertains to a laying rail or a launching support of a device for erecting bridges, especially collapsible bridges, and more particularly pertains to a launching support which is embedded in the laying beam, wherein a ground support is arranged at a free end of the laying rail or launching support.

BACKGROUND OF THE INVENTION

Devices of various designs for lowering or raising a bridge during erection by means of a laying rail or a launching support have been known.

Thus, a bridge-erecting device, which has a drivable hydraulic cylinder with bearing plate and is held pivotably in the launching support, has been known from DE 28 46 182 A1. This hydraulic cylinder can be driven from the vehicle only via flexible hydraulic double lines with numerous coupling points between the individual launching supports, between the launching support and the different bridge sections, as well as between the vehicle and bridge sections, where the hydraulic pump is located. In the case of a collapsible bridge according to DE 31 38 853 C2, the support feet are folded out and hydraulically extended at the top of the launching support when the ramp part of the launching support is already located on the laying device and is advanced forward. The disadvantage is that operating personnel must cross over to the other bank over the bridge, which has not yet been laid, in order to operate the hydraulic system.

A bridge-erecting device for collapsible, transportable bridges, which has a hanging-down ground support at its projecting front end of the first laying rail section, has been known from DE 31 06 140 C2. This support has, at its lower end, a transversely extending foot, which is attached in an articulated manner and is provided with two support plates, which are also arranged in an articulated manner. A hydraulic cylinder, which is operated by hand, is arranged between the foot and the support leg of the ground support.

A device for lowering and raising bridges, especially collapsible, stationary bridges, is designed according to DE 37 19 508 C2. According to this disclosure the tip part of the launching support is adjustable in height by a hydraulic cylinder by means of an adjusting device forming a hinge parallelogram.

The principal disadvantage of these prior-art laying systems is the relatively heavy metal construction, by which the cross section of the launching support or laying rail is unfavorably affected.

The support plates in these laying systems must be designed such that the supports and laying devices will have a secure hold even under unfavorable ground conditions.

SUMMARY AND OBJECTS OF THE INVENTION

The primary object of the present invention is to provide a lightweight, simple, and safe lowering device that can be operated automatically for bridges that can be erected mechanically.

According to the invention, a laying rail or launching support is provided in cooperation with a device for erecting bridges, particularly collapsible bridges. The launching support cooperates with a bridge having a bearing surface. The launching support includes a ground support attached to a free end of the launching support beam and is provided as a rigid construction. The lower limitation of the ground support end is above the bearing surface of the bridge. Inflatable container means is provided within the rigid construction, located within the ground support for providing a lower part of the container extending beyond the bearing surface of the bridge in an inflated state and providing a lower part of the container which does not extend beyond the bearing surface of the bridge in a collapsed state.

A releasing mechanism is provided cooperating with the inflated container means allowing the medium to escape when the bridge has completely reached its position at a bearing bank during advancing movement.

The device according to the present invention meets the requirements corresponding to the object set and is, moreover, characterized by a small space requirement and by the use of an environmentally friendly medium for raising and lowering the inflatable container.

Depending on the embodiment of the launching support or of the end of the laying rail, the device according to the present invention can be integrated under or in the tip of the launching support or of the laying rail. The space requirement for the flexible, inflatable container or containers depends on the lifting height of the launching support or of the laying rail, as well as on the overall height of the empty container.

Compressed air or another gaseous medium is usually used to inflate the collapsed container. The air may be taken from, e.g., the air tank of the onboard compressed air brake system of the laying vehicle. However, a steel cylinder containing compressed gas is also sufficient.

The inflatable container may consist of, e.g., heat-resistant, tear-resistant, and wear-resistant composite material based on a plastic, which contains steel cord inserts.

The air is automatically released from the inflatable container only when the end of the bridge has completely reached its bearing bank during rolling forward.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
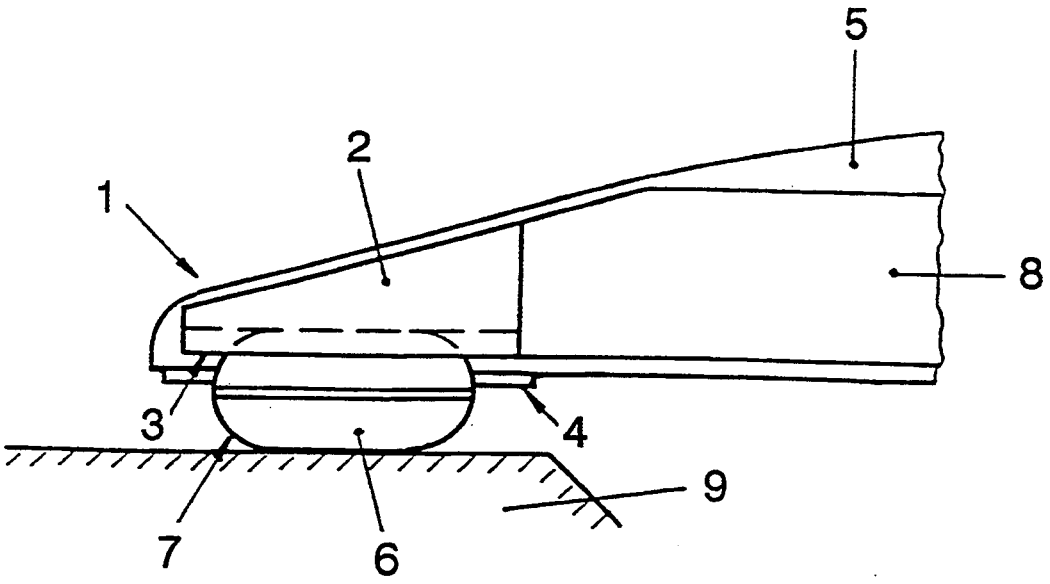
FIG. 1 is a longitudinal sectional view at the end of the bridge with inflatable container.

The ground support 1 shown in FIG. 1 includes a rigid structural part 2 for accommodating an inflatable container 6. Bearing forces, which consist of the own weight of the launching support 8 and of the bridge 5, are introduced by the inflatable container 6 into the launching support 8 and consequently into the laying device. The container 6 is arranged at the launching support 8 in the area of the bridge end 5. The lower limitation 3 of the structural part 2 is located above the bearing surface 4 of the bridge element 5. In the inflated state, the inflatable container 6 extends so far over the bearing surface 4 of the bridge 5 that uniform contact with the ground is guaranteed after the bridge 5 has been laid down, and the laying vehicle is thus loaded uniformly on all vehicle axles.

The inflation of the container 6 is initiated from the laying vehicle, preferably shortly before the ground support 1 is lowered.

Figure 2:
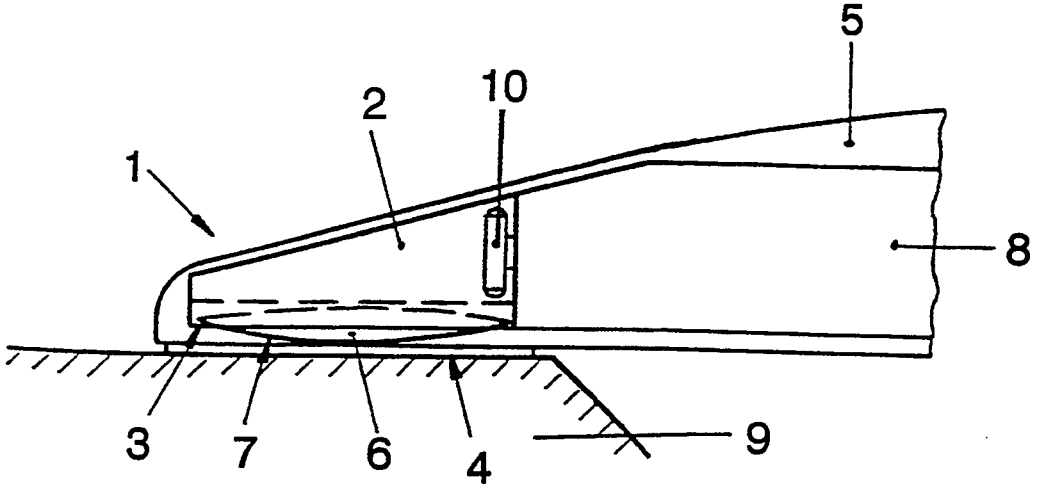
FIG. 2 is a longitudinal sectional view at the end of the bridge with inflatable container in a non-inflated state.

FIG. 2 shows a cross section of the ground supports 1 with the uninflated container 6, which does not extend beyond the lower bearing surface 4 of the bridge 5 in the collapsed state. The release mechanism 10, which ensures that the medium can escape from the inflated container 6 when the end of the bridge 5 has completely reached its bearing bank 9 during the forward advancing movement, may be arranged, e.g., in the top area of the structural part 2.

While a specific embodiment of the invention has been shown and described in detail to illustrate the application of the principles of the invention, it will be understood that the invention may be embodied otherwise without departing from such principles.

What is claimed is:

1. A launching support for erecting a bridge such as a collapsible bridge, comprising:

a launching support beam cooperating with the bridge, the bridge having a bearing surface, said launching support beam having an end;

a ground support provided at said end of said launching support beam, said ground support being provided as a rigid construction, connected at said end of said launching support beam, said ground support having a lower limitation above the bearing surface of the bridge; and inflatable container means arranged within said ground support for providing a lower container part extending beyond said bearing surface of the bridge in an inflated state and providing a lower part of the container which does not extend beyond the bearing surface of the bridge in a collapsed state.

2. A launching support according to claim 1, further comprising:

releasing mechanism means for allowing medium to escape from said inflatable container means when the bridge has completely reached a bearing bank during advancing movement of the bridge.

3. A bridge launching support, comprising: a bridge having a bearing surface; a launching support beam cooperating with said bridge, said launching support beam having an end; a ground support provided at said end of said launching support beam, said ground support being provided as a rigid construction connected to said end of said launching support beam, said ground support having a lower surface, above said bearing surface of said bridge; and inflatable container means for inflation to an inflated state and for deflation to a collapsed state, said inflatable container means being arranged within said ground support, said inflatable container means having a lower container surface extending below said bearing surface of said bridge in an inflated state and having a lower container surface, not extending beyond said bearing of said bridge, in a collapsed state.

4. A launching support according to claim 3, further comprising: release mechanism means for releasing medium from said inflatable container means.

5. A launching support for erecting a collapsible bridge, comprising:

a bridge having a lower bearing surface;

a launching support beam cooperating with said bridge, said launching support beam having a support end;

a ground support connected to said support end of said launching support beam, said ground support being formed as a rigid structure, located at said support end of said launching support beam, said ground support having a lower support surface located above said lower bearing surface of said bridge;

inflatable container means for inflation to an inflated state and for deflation to a collapsed state, said inflatable container means being positioned within said rigid structure of said ground support, said inflatable container means having a lower inflatable container surface extending below said bearing surface of said bridge in an inflated state and not extending below said bearing surface in a collapsed state; and releasing mechanism means for allowing medium to escape from said inflatable container means.

* * * * *